FIG. 1.
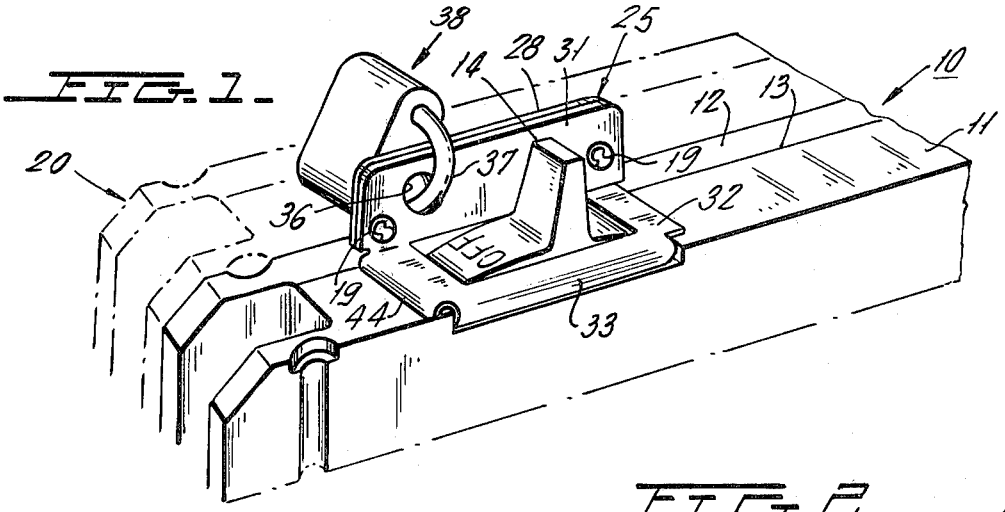
FIG. 2.
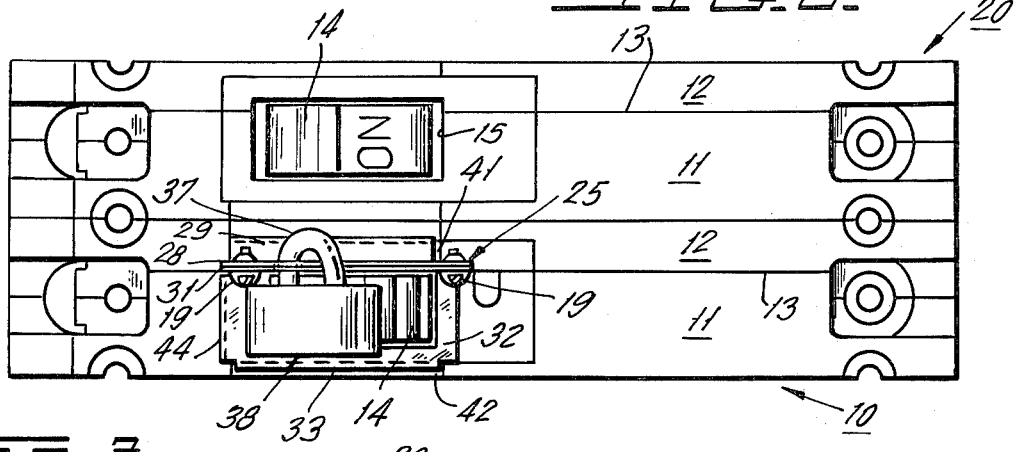
FIG. 3.
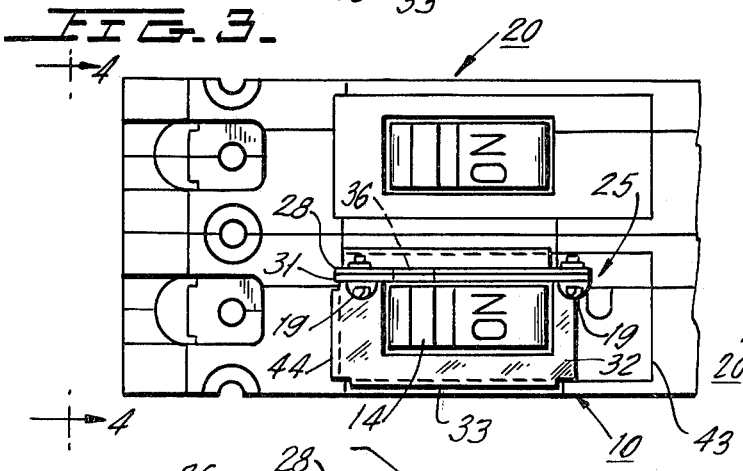
FIG. 4.
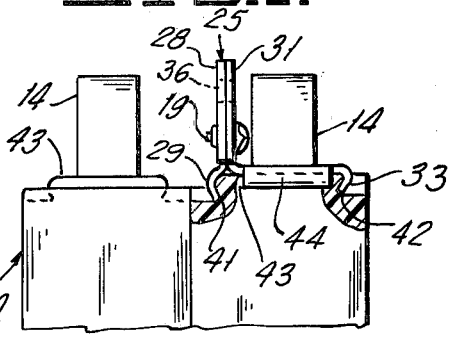
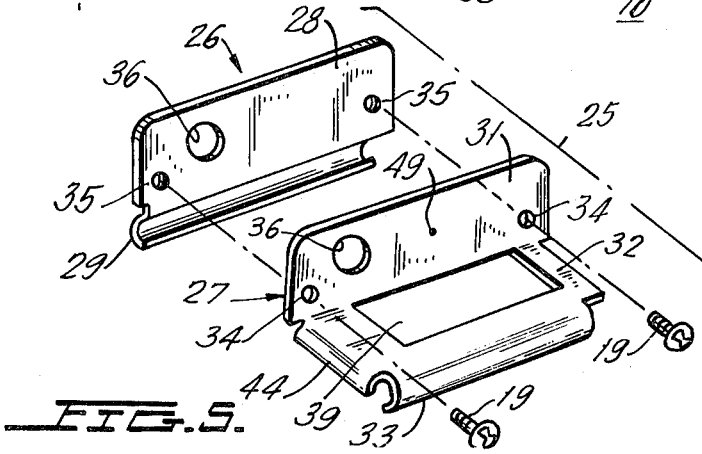
FIG. 5.
FIG. 6.
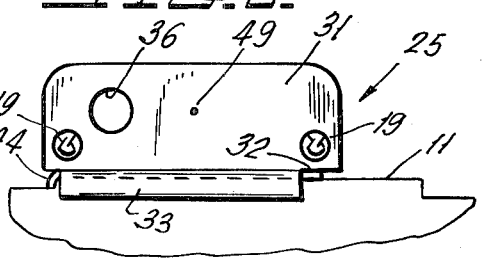

United States Patent [19]

Clement et al.

[11] 4,160,137

[45] Jul. 3, 1979

[54] BRACKET MEANS TO MOUNT A PADLOCK FOR BLOCKING MOVEMENT OF A SWITCH HANDLE

[75] Inventors: Ralph C. Clement; William R. Latimer, both of Bellefontaine, Ohio

[73] Assignee: Gould Inc., Rolling Meadows, Ill.

[21] Appl. No.: 865,224

[22] Filed: Dec. 28, 1977

[51] Int. Cl.[2] ..... H01H 27/00
[52] U.S. Cl. ..... 200/42 T
[58] Field of Search ..... 200/42 T, 44; 70/57

[56] References Cited

U.S. PATENT DOCUMENTS

| | | | |
|---|---|---|---|
| 2,169,860 | 8/1939 | Von Hoorn | 200/44 |
| 3,055,995 | 9/1962 | Snow | 200/42 T |
| 3,312,794 | 4/1967 | Hollyday | 200/42 T |
| 3,595,040 | 7/1971 | Curi | 200/42 T |

*Primary Examiner*—Herbert F. Ross
*Attorney, Agent, or Firm*—Ostrolenk, Faber, Gerb & Soffen

[57] ABSTRACT

An L-shaped member and a generally flat member are secured together by one-way screw to form a bracket assembly mounted on the front of a circuit breaker housing to receive a padlock for blocking movement of the circuit breaker handle to the ON position.

11 Claims, 6 Drawing Figures

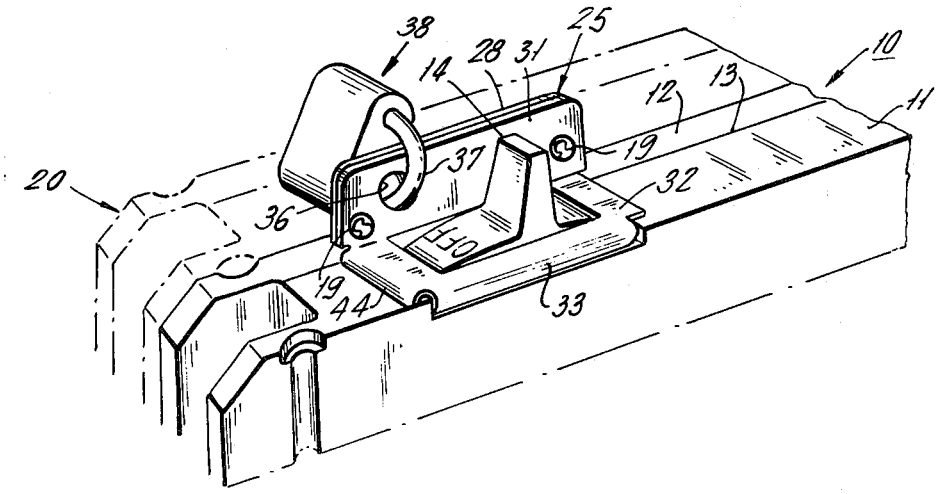

BRACKET MEANS TO MOUNT A PADLOCK FOR BLOCKING MOVEMENT OF A SWITCH HANDLE

This invention relates to blocking means for a circuit breaker handle and relates more particularly to a blocking means of this type which is field installable with a screwdriver.

There are numerous instances when it becomes necessary to assure that one or more circuit breakers in a panelboard not be operated to closed circuit position, while at the same time the other circuit breakers should be freely operable to both opened and closed circuit positions. This is accomplished by providing the individual circuit breakers with a bracket means to receive a padlock which is then positioned so as to block movement of the circuit breaker handle to its On position. It is required that this bracket means be secured in such a manner that an unauthorized person cannot readily remove or otherwise tamper with the bracket means to defeat its intended purpose.

The prior art has provided bracket means of this type but field installation thereof was often not feasible. For those field installable bracket means of the prior art installation usually required that the panelboard dead front cover plate be removed or it was necessary to completely dismount the circuit breaker in question from the panelboard.

To overcome these disadvantages of the prior art the instant invention provides a bracket means constructed of an L-shaped member and a generally flat member secured together by one-way screws. These members are provided with curved mounting feet having concave surfaces which face one another and extend into undercut recesses adjacent the forward surface of the circuit breaker to operatively secure the bracket means to the circuit breaker. With the bracket means secured to the circuit breaker the flat member and one leg of the L-shaped member extend forward. This leg and the flat member are provided with aligned apertures which receive the shackle of a padlock. The other leg of the L-shaped member is provided with an elongated window through which the circuit breaker operating handle extends and moves between On and Off circuit positions. This leg of the L-shaped member also includes a rearwardly extending lip for keying the bracket means in its operative position.

Accordingly, a primary object of the instant invention is to provide a novel construction for a field installable bracket means to receive and position a padlock on a circuit breaker to prevent closing thereof.

Another object is to provide a bracket means of this type which is of inexpensive construction and does not require the use of special tools for installation thereof.

Still another object is to provide a bracket means of this type which cannot be installed in an improper position.

A further object is to provide a bracket means of this type that may be installed without dismounting the circuit breaker from a panelboard and without removing the dead front cover of the panelboard.

These objects as well as other objects of this invention will become apparent after reading the following description of the accompanying drawings in which:

FIG. 1 is a fragmentary perspective of a circuit breaker having the bracket means of the instant invention installed thereon and mounting a padlock which blocks the circuit breaker handle to prevent movement thereof to the On position.

FIG. 2 is a plan view showing the elements of FIG. 1 positioned adjacent another circuit breaker.

FIG. 3 is a fragmentary portion of the elements of FIG. 2 with a padlock removed.

FIG. 4 is an end view of the elements of FIG. 3 looking in the direction of arrows 4—4.

FIG. 5 is an exploded perspective of the bracket means elements.

FIG. 6 is a side elevation of the bracket means.

Now referring to the Figures. Single pole circuit breaker 10 is of the type described in detail to the T. J. Rys copending U.S. Patent applications Ser. No. 703,078 filed July 6, 1976 and No. 763,888 filed Jan. 31, 1977. Briefly, circuit breaker 10 includes a hollow molded insulating housing consisting of base 11 and cover 12 which mate along line 13. Disposed within housing 11, 12 are the current carrying elements (not shown) and contact operating mechanism (not shown). The latter is manually operable by handle 14 extending forward of housing 11, 12 through an elongated aperture 15 in the forward surface of housing 11, 12.

In FIGS. 1 through 4 circuit breaker 10 is shown stacked side to side with an identical circuit breaker 20 so that identical elements of circuit breakers 10 and 20 are identified by the same reference numeral.

Mounted to the front of circuit breaker 10 is bracket means 25 which consists of two members 26, 27 constructed of relatively stiff spring steel. Bracket member 26 includes rectangular flat main section 28 having curved foot 29 along its rear edge. Bracket member 27 is of generally L-shaped cross-section and includes generally rectangular legs 31, 32. Leg 32 along its edge remote from leg 31 is provided with curved foot 33 of essentially the same cross-section as foot 29. Two one-way screws 19 extend through clearance apertures 34 in leg 31 and are received by threaded apertures 35 in main section 28 to secure members 26, 27 together with main section 28 adjacent to leg 31 and apertures 36 in main section 28 and leg 31 being aligned to receive shackle 37 of padlock 38.

With bracket members 26, 27 assembled the concave surfaces of feet 29, 33 face one another and the free edges thereof extend into respective undercut grooves 41, 42 in the sides of shallow escutcheon 43 formed integrally with the front of housing 11, 12. Grooves 41, 42 and feet 29, 33 are generally of the same length to establish the proper end-to-end position for bracket means 25 on housing 11, 12. Rearwardly extending lip 44 at one end of leg 32, in cooperation with one end of escutcheon 43, constitutes a keying means to assure that bracket means 25 cannot be mounted in an improper position on circuit breaker housing 11, 12. Rectangular aperture 39 in leg 32 is disposed in front of housing opening 15 in alignment therewith to provide clearance for movement of operating handle 14.

With bracket means 25 in operative position mounted to housing 11, 12, leg 31 extends forward of housing 11, 12 in a plane generally parallel to the plane of movement for handle 14 and there is a relatively narrow spacing between leg 31 and one side of handle 14. Thus, with padlock 38 mounted to bracket means 25 shackle 39 is positioned by aperture 36 so as to block movement of handle 14 of circuit breaker 10 to the circuit breaker On position. Handle 14 of circuit breaker 10 when in the On position is aligned with aperture 36 to prevent insertion of a lock shackle therethrough so that handle 14 cannot be locked in the On position inadvertently.

In the event it is desired to utilize bracket means 25 as a means for preventing operation of handle 14 to the Off position, another aperture having a center at dimple 49 in leg 31 may be drilled through leg 31 and main section 28. It is noted that shackle 37 does not interfere with operation of handle 14 on circuit breaker 20.

It is noted that while it is a simple matter to mount bracket means 25 to circuit breaker housing 11, 12 merely by utilizing a common screwdriver, once screws 19 are tightened special tools are required to dismount bracket means 25. That is, since one-way screws 19 have special heads more than a simple screwdriver is required to order to loosen screws 19.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. An electrical switch and a field installable device to receive a padlock in operative position blocking movement of a switch operating handle to ON position; said switch including an insulating housing and an operating handle mounted for movement between ON and OFF positions, said handle projecting outside of said housing for manual engagement; said device including bracket means comprising first and second elements having respective first and second feet in holding positions inserted into external recesses of said housing for mounting said device on said switch, securing means holding said first and second elements fixed with respect to each other and in operative position wherein said feet are maintained in said holding positions, said bracket means including aperture means to receive a lock shackle and thereby position such lock to block movement of said handle to its said ON position.

2. An electrical switch and device as set forth in claim 1 in which the first element is generally L-shaped and the second element includes a main section positioned adjacent one leg of said first element.

3. An electrical switch and device as set forth in claim 2 in which the other leg of the first element includes a window to receive said handle and provide clearance for operation of the latter between said ON and OFF positions.

4. An electrical switch and device as set forth in claim 3 in which the first foot is disposed along the edge of said other leg remote from said one leg and the second foot is disposed adjacent the junction between said legs.

5. An electrical switch and device as set forth in claim 4 in which said feet include elongated concave surfaces which face one another.

6. An electrical switch and device as set forth in claim 5 in which said first element includes a positioning lip along one end thereof.

7. An electrical switch and device as set forth in claim 4 in which the securing means includes a plurality of one-way screws threadably mounted to said bracket means.

8. An electrical switch and device as set forth in claim 7 in which each of the one-way screws pass through aligned apertures in said main section and said second leg.

9. An electrical switch and device as set forth in claim 8 in which said feet include elongated concave surfaces which face one another.

10. An electrical switch and device as set forth in claim 9 in which said first element includes a positioning lip along one end thereof.

11. An electrical switch and device as set forth in claim 1 in which the aperture means is operatively positioned whereby said handle when in said ON position blocks mounting of a lock to said device by insertion of a shackle through said aperture means.

* * * * *